US007036718B2

(12) United States Patent
Quaintance

(10) Patent No.: US 7,036,718 B2
(45) Date of Patent: May 2, 2006

(54) OFFSET DOVE TAIL LOCKS

(75) Inventor: Benjamin W. Quaintance, Germantown, TN (US)

(73) Assignee: International Paper Company, Stamford, CT (US)

( * ) Notice: Subject to any disclaimer, the term of this patent is extended or adjusted under 35 U.S.C. 154(b) by 142 days.

(21) Appl. No.: 10/388,567

(22) Filed: Mar. 15, 2003

(65) Prior Publication Data

US 2004/0007613 A1 Jan. 15, 2004

Related U.S. Application Data

(60) Provisional application No. 60/365,007, filed on Mar. 14, 2002.

(51) Int. Cl.
*B25D 5/22* (2006.01)

(52) U.S. Cl. ..... 229/177; 229/933; 229/109; 229/179

(58) Field of Classification Search ..... 229/177, 229/178, 179, 117, 917, 915, 916, 933, 935
See application file for complete search history.

(56) References Cited

U.S. PATENT DOCUMENTS 743,205 A * 11/1903 Tupper et al. ..... 220/682
1,255,810 A 2/1918 Taylor
1,666,204 A 4/1928 Harshberger
2,127,131 A 8/1938 Moeller
3,037,681 A 6/1962 Kuchenbecker et al.
3,749,300 A 7/1973 Jones
3,883,067 A * 5/1975 McGlynn et al. ..... 229/177
4,137,829 A 2/1979 Sarka
4,372,476 A * 2/1983 Harned et al. ..... 229/120.17
4,561,334 A 12/1985 Sarka
4,600,142 A * 7/1986 Quaintance ..... 229/143
5,236,122 A * 8/1993 Ballard ..... 229/102
5,474,231 A * 12/1995 Froom ..... 229/132
5,484,102 A * 1/1996 DeMay ..... 229/132

* cited by examiner

*Primary Examiner*—T. Mai
(74) *Attorney, Agent, or Firm*—Daniel C. Stelter

(57) ABSTRACT

A container for carrying produce having dove tail locks is created from a container blank having nonsymmetrical, offset dove tail locks on the edges of the blank. When the blank is on a larger paperboard substrate having multiple blanks, the dove tail locks of a blank border the dove tail locks of an adjacent blank in a configuration that eliminates pinch points. The elimination of pinch points is achieved by having dove tail locks wherein the sides of the dove tail lock diverge from each other at different angles and for different horizontal vectors.

18 Claims, 7 Drawing Sheets

OFFSET DOVE TAIL LOCKS

RELATED APPLICATION

This application claims the benefit of U.S. Provisional Application Ser. No. 60/365,007, filed Mar. 14, 2002.

FIELD OF THE INVENTION

The present invention relates to a paper or paperboard container having dove tail locks, wherein the paperboard container is created form a blank having offset, non-symmetrical dove tail locks. Further, the present invention relates to a paperboard substrate having multiple contiguous paperboard blanks, wherein the dove tail locks of one blank border the dove tail locks of an adjacent blank in a configuration that eliminates angles of less than 90 degrees.

BACKGROUND OF THE INVENTION

Corrugated paperboard is typically used in many different applications, for example, to form containers, boxes, cartons, or dividers for holding, storing or shipping various items such as agricultural produce.

Typically, such containers have a bottom and four side walls, and are formed from a blank scored with score lines or cut lines. The blanks are most often formed by automated machines in a continuous in-line process involving scoring and cutting a large substrate of paperboard into blanks of a desired configuration. During scoring and cutting, multiple, virtually identical container blanks are contiguously formed on a large, single substrate of paperboard. The automated machines separate the substrate into individual blanks by severing common intermediate cut lines with cutting knives. The resultant individual blanks are then folded along the score lines or cut lines to form functional containers. The blanks may be folded into a container manually or by an automated machine.

An individual container blank, on its own, often contains knife recesses or other cut out formations along the outer edges of the blank. However, during severance from a large paperboard substrate, the outer edge of the blank borders a virtually identical blank along an intermediate common cut line. In these circumstances, the die cut recesses or other cut out formations touch each other across the intermediate common cut line, essentially forming a combined cut out shape. For example, a blank may include dove tail locks, which are recesses having a flat base and two angled side walls that extend from the base to an open mouth top at the edge of the side wall, and may further have identical recesses on an opposing side edge. When this happens on contiguous blanks on a larger paperboard substrate, the open mouth of the dove tail lock on one blank will border the open mouth of a dovetail lock on an adjacent blank. As a result, the two bordering locks form a single, larger cut out shape that traverses the intermediate common cut line. When the blanks are fully separated across the intermediate common cut line, the individual blanks once again have separate dove tail locks.

However, to account for the thickness of the blank's panels when they are folded over one another during the formation of the container, the recesses cut out of one end of a blank are sometimes offset from the recesses on the opposite end of the blank by moving one recess a small lateral distance as opposed to the other. For example, the dove tail lock on one end of a blank can be laterally spaced ⅛ inch from a dove tail lock on the opposing edge. Stemming from that offset, when the blanks are arranged adjacently on a single substrate, the dove tail locks on one blank are offset from the bordering dove tail lock on the adjacent blank. That is to say, the open mouth top of the dove tail lock on one blank does not perfectly align with the open mouth top of the adjacent dove tail lock. This results in a combined cut out shape having sharp angles of less than 90°, called pinch points, which are undesirable because they are difficult to properly cut, leaving frayed edges and causing extra wear and tear on the cutting knife.

Therefore, it is an object of this invention to provide a paperboard blank that eliminates pinch points when aligned with an adjacent, identical blank on the same paperboard substrate.

SUMMARY OF THE INVENTION

The present invention comprises a paperboard container formed from a paperboard blank, wherein the blank contains non-symmetrical offset dove tail locks, which eliminate pinch points and increase the ease of separating the blank from a larger paperboard substrate.

The container is a corrugated box of a type often used for transporting food items, with a bottom side, two side walls, two end walls and a removable lid. The container further contains dove tail locks on the end walls to facilitate the locking of the container in an upright, erect position. A dove tail lock, as stated above, is a cut recess wherein the shape of the recess resembles a tail of a bird, that is to say, it is a recess with a base line, two angled slope lines moving in diverging or converging paths, and an open mouth top.

When the container is in its blank form, the dove tail locks are cut into opposing sides of the container blank. Each dove tail lock is offset from its opposing dove tail lock by a small lateral distance to account for the thickness of the paperboard during folding. However, the offset opposing dove tail locks are non-symmetrical, such that each slope line of the dove tail locks extend at different horizontal distances (vectors). The different vectors result in each slope line extending a different horizontal distance during its path from the base line to the open top than its corresponding, opposing slope line. The difference in the horizontal distances eliminates pinch points by aligning the open mouth tops of two adjacent dove tail locks together.

One embodiment of the invention includes dove tail locks having a base line, two slope lines and an open mouth top, wherein the slope lines of the locks are single lines that angle divergently away from each other at different angles relative to the base line. Each slope line of the dove tail locks crosses different horizontal vectors, creating a non-symmetrical lock that eliminates pinch points when multiple blanks are contiguously scored and cut on a single paperboard substrate.

Further embodiments include dove tail locks wherein the slope lines of the locks are segmented. In these embodiments, one segment extends perpendicular to the base and in parallel to a corresponding segment on the opposing side of the lock. The parallel segments combine with second segments that extend divergently away from each other at different angles relative to the base line and the first segments. This embodiment also results in each slope line of the dove tail lock traveling different horizontal vectors, eliminating pinch points when the blank borders an adjacent blank on a paperboard substrate.

Other objects, embodiments, features and advantages of the present invention will be apparent when the description of a preferred embodiment of the invention is considered in conjunction with the annexed drawings, which should be construed in an illustrative and not limiting sense.

BRIEF DESCRIPTION OF THE FIGURES/DRAWINGS

Figure 3:
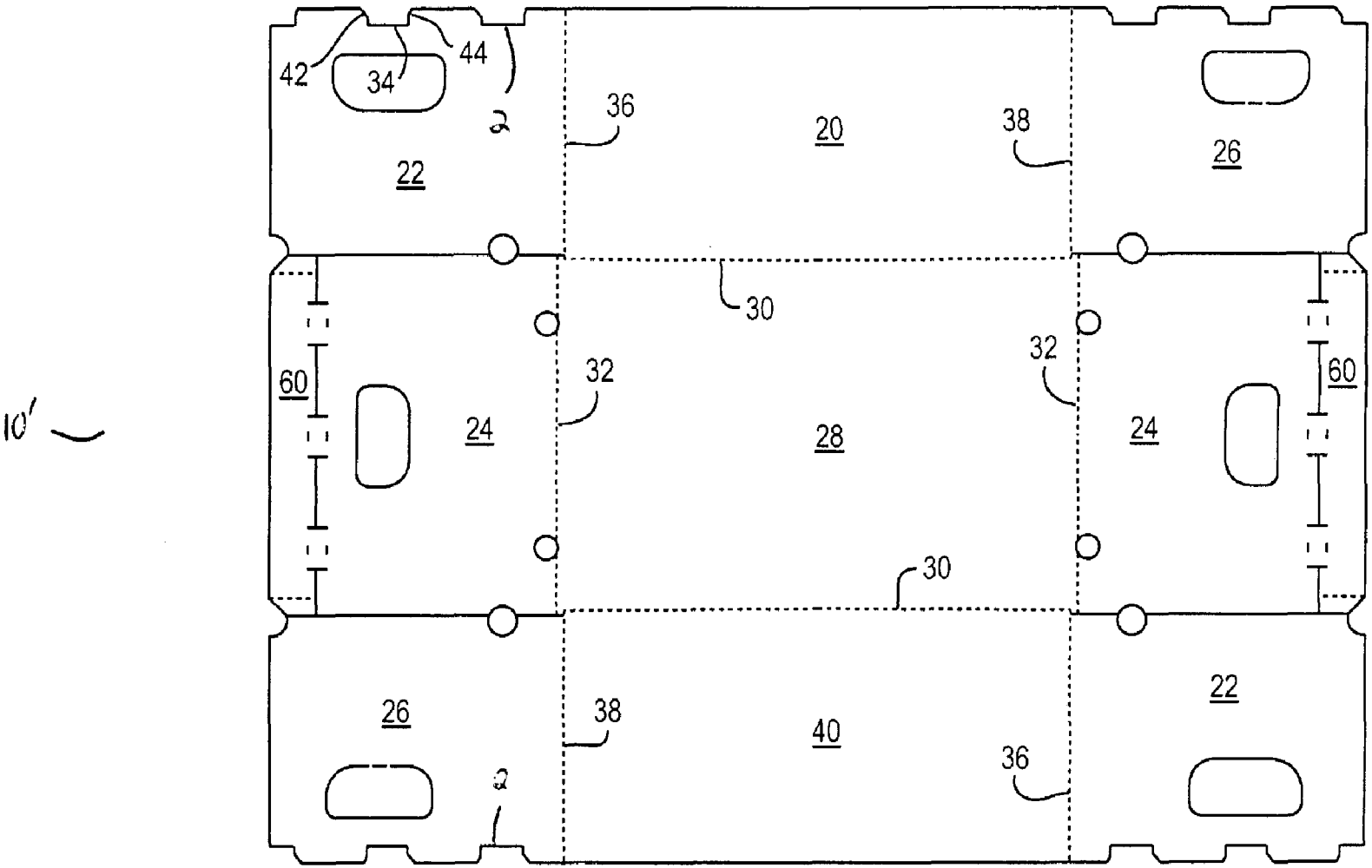
FIG. 3 is a plan view of a paperboard blank.
Figure 4:
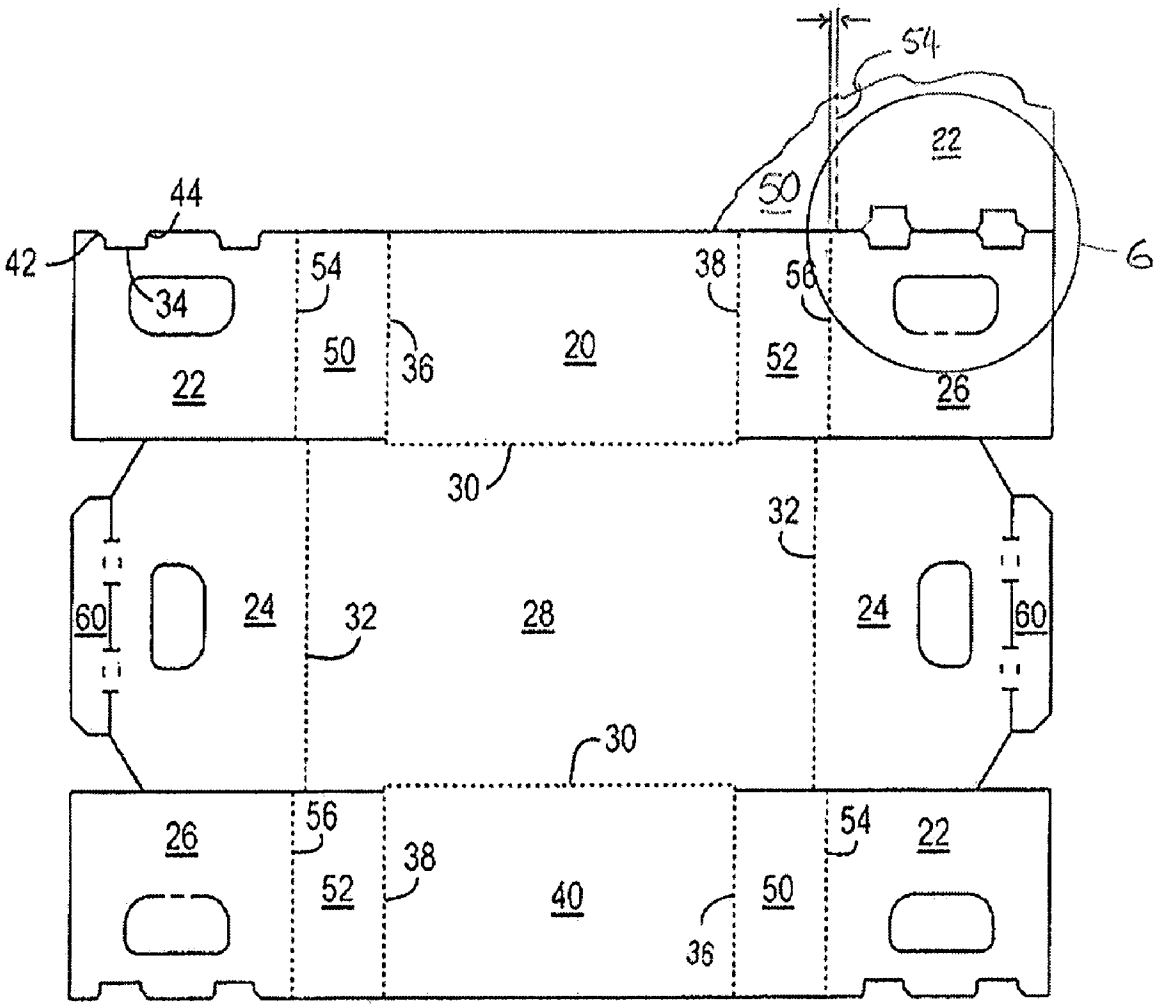
FIG. 4 is a plan view of an alternate embodiment of a paperboard blank.
Figure 7B:
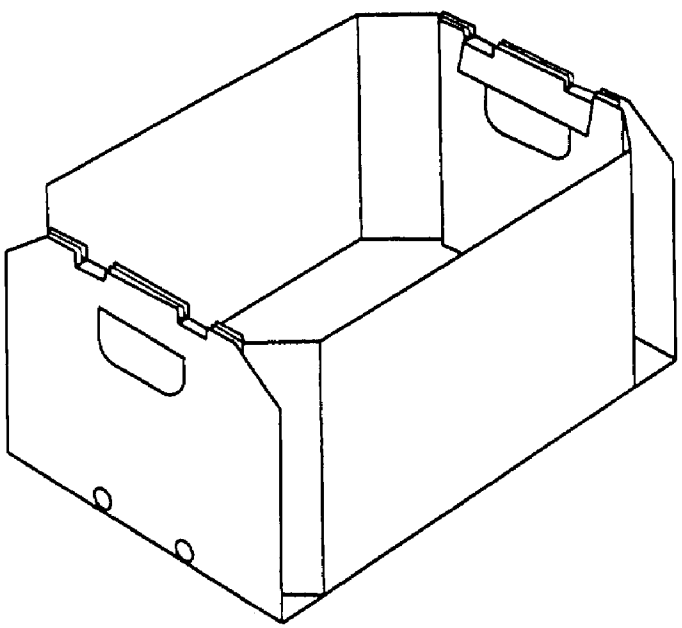
Figure 7A:
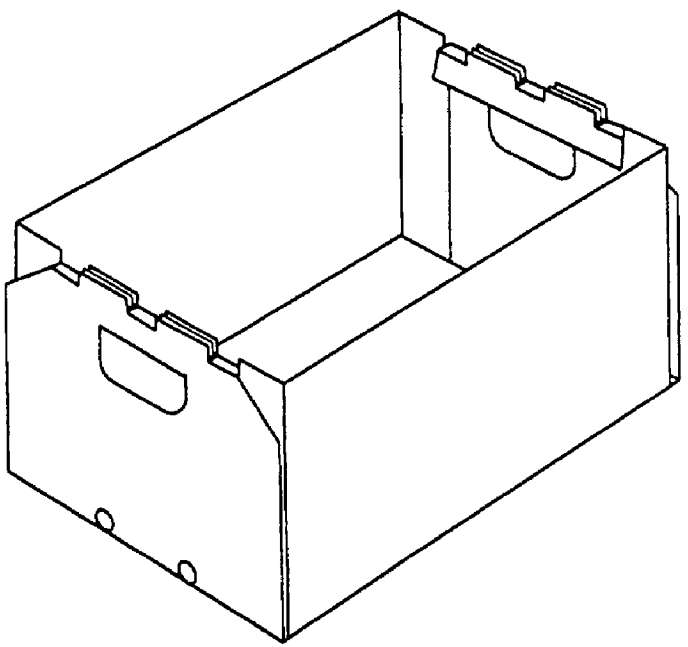

FIGS. 7*a*–7*b* are perspective views of the container blanks of FIGS. 3 and 4 folded and erected into a container.

DETAILED DESCRIPTION

Figure 1:
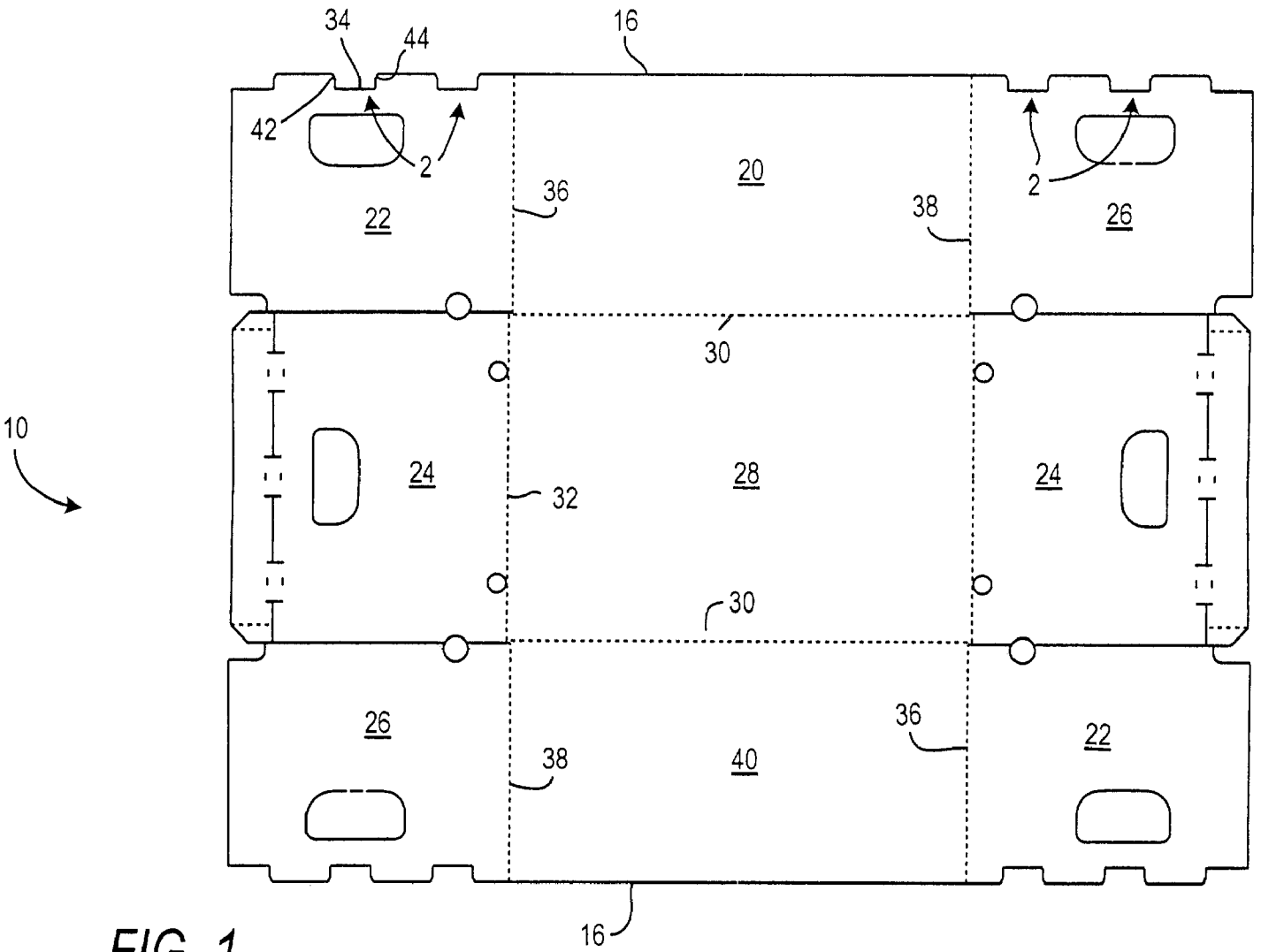
FIG. 1 PRIOR ART
FIG. 1 is a plan view of a prior art paperboard blank.
Figure 2:
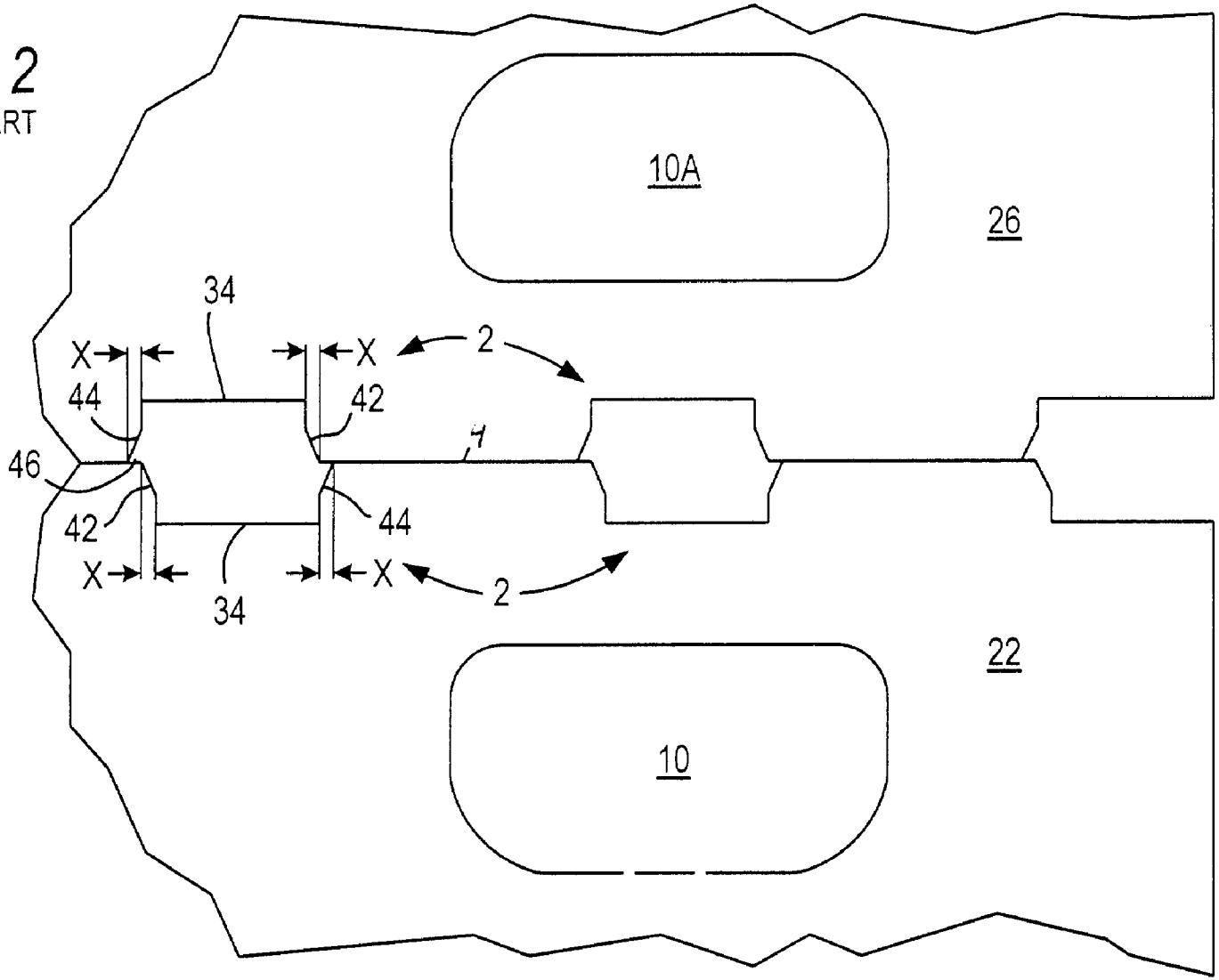
FIG. 2 PRIOR ART
FIG. 2 is a partial view of two adjacent prior art blanks on a paperboard substrate.

FIGS. 1 and 2 show prior art blank 10 scored and cut from a larger corrugated substrate, wherein the corrugated substrate contains multiple substrates in a contiguous arrangement. Blank 10 is a poultry container with a base panel 28, end panels 24 foldably attached to base panel 28 along opposite, parallel fold lines 32, and side panels 20 and 40, foldably attached to base panel 28 along opposite, parallel fold lines 30. Each side panel has two end flaps, 22 or 26, foldably attached to the side panel along opposite fold lines 36 and 38.

Each end flap has at least one dove tail lock 2. The dove tail locks are die cut recesses, cut from the outer edge of the side panels. Referring to FIG. 2, die cut recesses are generally trapezoidal in shape, with a base line 34, two slope lines 42 and 44 diagonally diverging at identical vectors and angles relative to the base line, and an open mouth top. Slope lines 42 and 44 are segmented, wherein the first segments extend perpendicular from the base line and parallel to each other, and the second segment diverge at identical vectors X relative to the base line. In other prior art embodiments, slope lines 42 and 44 may be a single line with a vector X, without any segmentation.

To erect the container, side panels 20 and 40 of FIG. 1 are first folded about a horizontal axis 30, upwards about 90°, out of the plane of the base panel. Second, end flaps 22 and 26 at the ends of the side panels are folded along vertical fold lines 36 and 38 toward the base panel about 90°, wherein they overlap each other in a face-to-face arrangement, such that their respective dove tail locks similarly overlap one another. Third, end panels 24 are folded upwards, out of the plane of the base panel. End panel 24 overlaps end flaps 22 and 26 in a face-to-face arrangement, resulting in a three-ply end wall that is triple the thickness of the blank.

To overlap properly, however, the thickness of the paperboard must be accounted for. Failing to do so would result in end panel 22 and end panel 26 obstructing each other by attempting to fold into the same location. Avoiding this requires the length of end panel 22 to be slightly different than the length of end panel 26. As a result of this length difference, each end panel naturally folds next each other without interference.

Corresponding with the length differences of the end panels, the dove tail locks on end panels 22 are offset a small lateral distance as compared to the dove tail locks on end panels 26. This offset accounts for the thickness of the paperboard and allows the dove tail locks to properly align with each other when overlapped on the end wall.

Prior art blank 10 is generally scored and cut on a large paperboard substrate with multiple other blanks in a continuous in-line process. FIG. 2 shows the prior art with a partial view of two adjacent paperboard blanks, 10 and 10A, particularly their end flaps 22 and 26. The open top mouth of the dove tail locks on blank 10 are adjacent to the open top mouth of dove tail locks on blank 10A. Due to slightly different lengths of the end flap and corresponding offset of the dove tail locks, the open ended sides of the dove tail locks are offset a small distance X, in the present example about ⅛ inch. The result of this offset are small cut-out shapes 46 that have angles of less than 90°, called pinch points, which are undesirable because they are difficult to properly cut when the adjacent blanks are severed along intermediate common cut line 4, creating frayed edges and causing extra wear and tear on the cutting knife.

One embodiment of the present invention is shown in FIG. 3. Blank 10' is a blank scored and cut from a larger corrugated substrate, wherein the substrate contains multiple container blanks adjacent to one another. Blank 10' has a base panel 28, end panels 24 foldably attached to base panel 28 along opposite, parallel fold lines 32, and side panels 20 and 40 foldably attached to base panel 28 along opposite, parallel fold lines 30. Side panels 20 and 40 each have two end flaps foldably attached to the side panel along opposite fold lines 36 and 38. End flaps 22 foldably attach along fold line 36, and end flaps 26 foldably attach along fold line 38. The lengths of end flaps 22 and 26 are slightly different to account for the thickness of the flaps when they are folded over one another in a face-to-face arrangement when the container is erected. For example, in the current example, end flap 22 is ⅛ of an inch longer than end flap 26.

Each side flap has at least one dove tail lock 2. The dove tail locks are die cut recesses, cut out from the outer edge of the side panels. The die cut recesses are generally trapezoidal in shape, with a base line 34, two opposing slope lines 42 and 44 diagonally diverging at different angles relative to the base line, and an open mouth top. The different angles of the opposing slope lines result in different horizontal vectors of the slope lines, i.e., the slope lines travel different horizontal distances as they extend from the base line to the open top mouth. For example, in the present example, slope line 42 has a horizontal vector of ¼ inch, while slope line 44 has a horizontal vector of ⅛ inch. In general, the difference of the horizontal vectors of the two slope lines is equivalent to the difference in length of end flap 22 and end flap 26.

In the embodiment shown in FIGS. 3–6, each slope line is made up of two segments. The first segment of each slope line extends perpendicularly from base line 34. The second segment of each slope line extends at an angle from the end of the first segments to the top edge of the end panel. The second segments diverge at different angles relative to the base line and the first segment, resulting in a horizontal vector of the second segment of slope line 42 being different than the second segment of slope line 44. In the present example, the second segment of slope line 42 has a horizontal vector of ¼ inch, whereas the second segment of slope line 44 has a horizontal vector of ⅛ inch.

Figure 5:
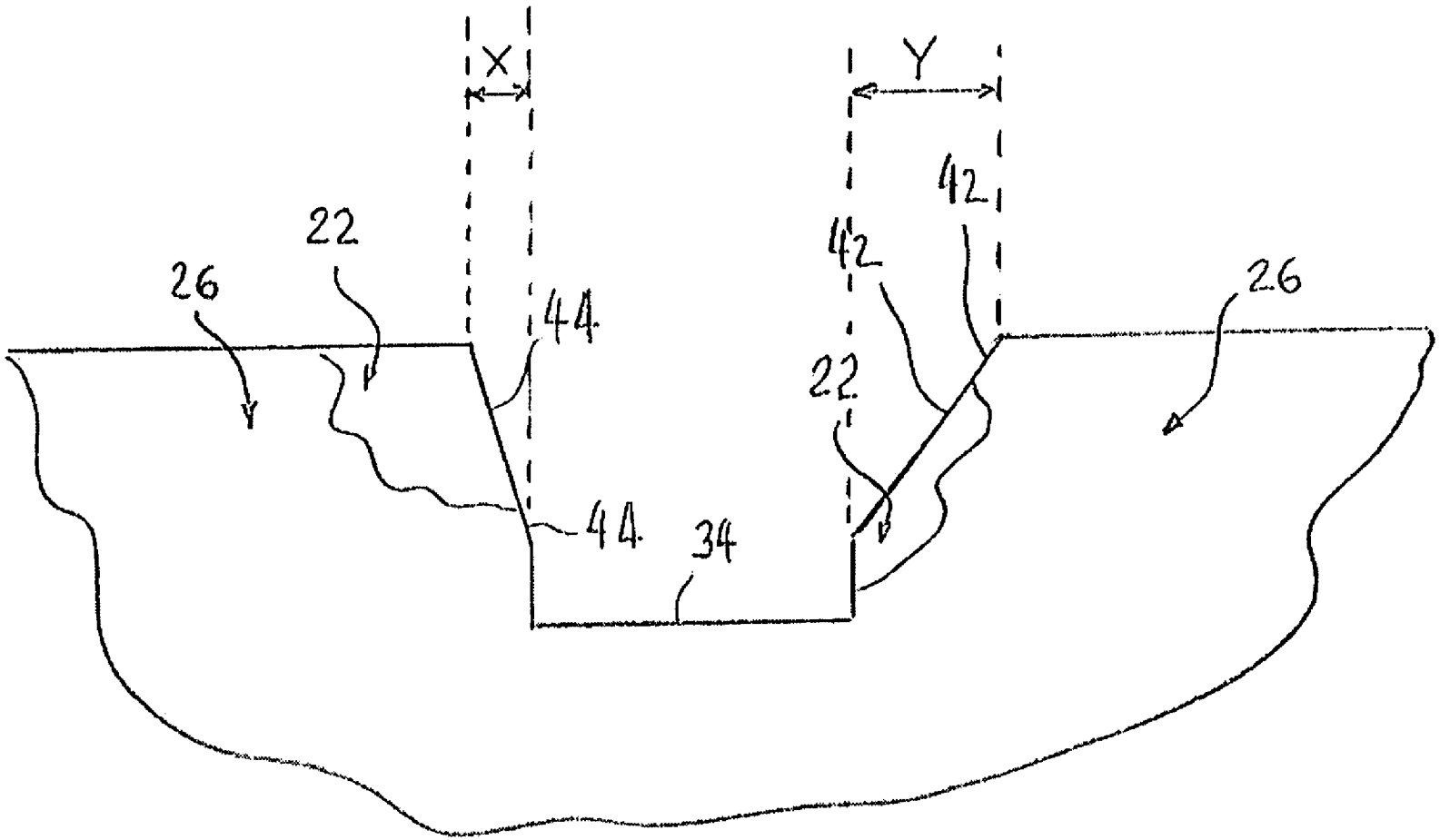
FIG. 5 is a partial view of two end panels of FIG. 3 and their respective dove tail locks overlapping.

To erect the container of FIG. 3, side panels 20 and 40 are first folded about a horizontal axis 30, upwards 90°, out of the plane of the base panel. Second, end flaps 22 and 26 are folded along vertical axis 36 and 38 toward the base panel about 90°, overlapping each other. As shown in FIG. 5, when end flaps 22 and 26 overlap one another, the dove tail locks of the end panels similarly overlap one another, creating a thicker combined recess in the end wall. To align evenly, the slope line with a horizontal vector X on flap 22 matches with the corresponding slope line of the same vector on flap 26. Likewise, the slope line with a horizontal vector Y on flap 22 aligns with the corresponding slope line of the horizontal vector on flap 26. The resultant combined recess is asymmetrical yet aligned without excess paperboard of one panel protruding into the recess of an adjacent panel.

Third, end panels 24 are folded about horizontal axis 32 upwards 90° out of the plane. The end flaps 22 and 26 overlap each other and end panel 24 in a face-to-face-to-face arrangement, resulting in a three-ply end wall that is triple the thickness of the blank. The locking flap 60 is then pulled down through the dove tail locks of flaps 22 and 26, locking the container in an erect position, shown in FIG. 7A.

An alternate embodiment is shown in FIG. 4. Middle panels 50 and 52 are located between each side panel and their respective end flaps 22 and 26. Flaps 22 and 26 foldably attach to middle panels 50 and 52 along score lines 54 and 56. To account for the thickness of the paperboard during folding, the length of middle panel 50 is slightly different than the length of middle panel 52 (about ⅛ of an inch in the present example). As a result, opposing end flaps 22 and 26 and their respective dove tail locks are laterally offset from each other. However, slope lines 42 and 44 of dove tail locks 2 extend different horizontal distances, accounting for the offset, eliminating pinch points when cutting on a larger paperboard substrate. When the blank shown in FIG. 4 is erected, the result is the container shown in FIG. 7B.

Figure 6:
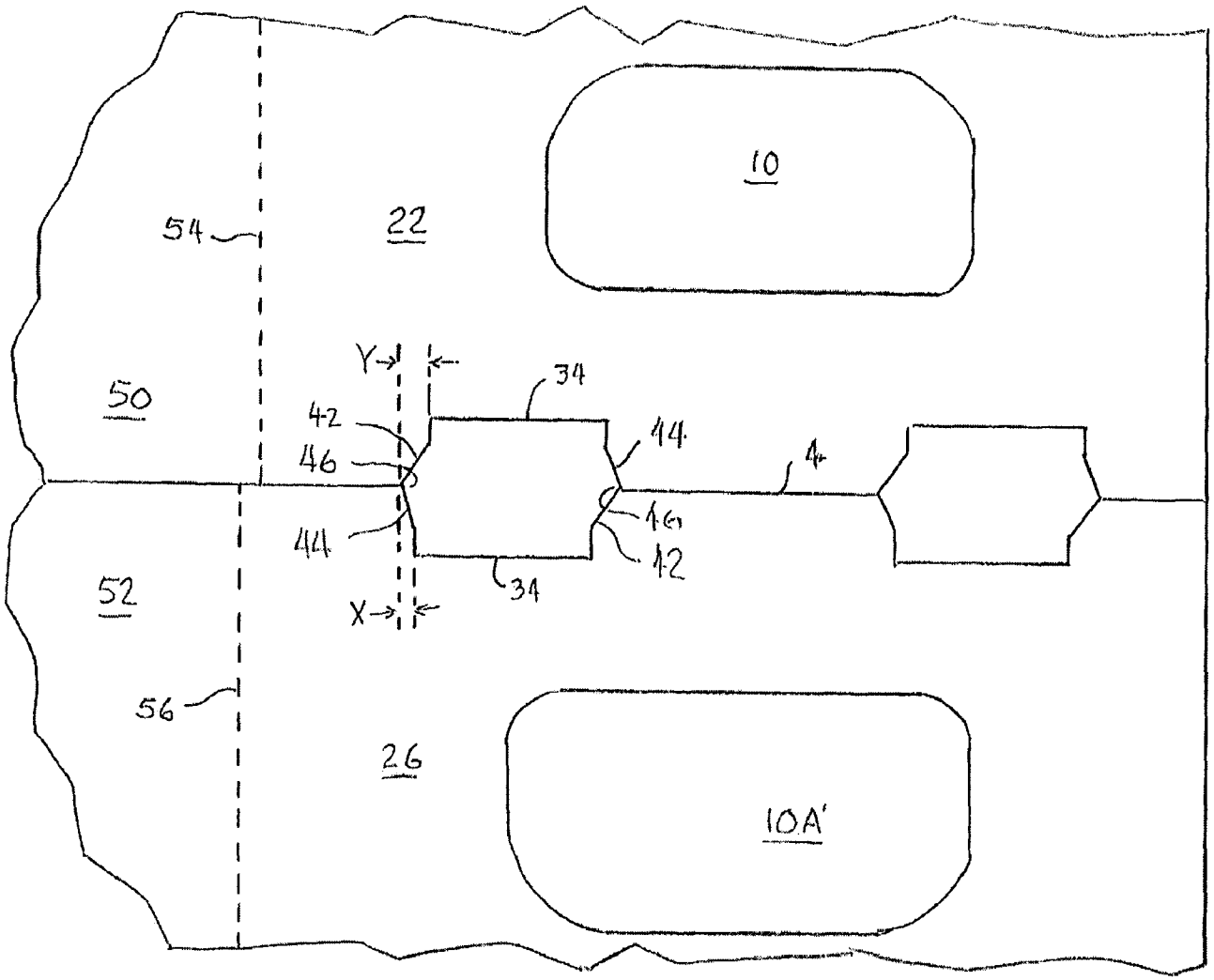
FIG. 6 is an enlarged partial view of two adjacent blanks on a paperboard substrate, taken in the area circled at 6 in FIG. 4.

When blank 10' of FIG. 3 or 4 is scored and cut on a paperboard substrate in a continuous in-line process, multiple blanks are scored and cut on the same substrate, wherein the intermediate cut line is cut simultaneously with the cutting of the dove tail locks. FIG. 6 shows a partial view of two adjacent paperboard blanks, 10' and 10A', particularly their end flaps 22 and 26, post cutting. The dove tail locks 2 on blank 10' lie adjacent to dove tail locks 2 on blank 10A'. Due to slightly different lengths of the side flaps, base lines 34 of the dove tail locks are laterally offset. However, the offset is accounted for by the horizontal vector Y of slope line 42, which, unlike the prior art, is different than the horizontal vector X of slope line 44. Ideally, the horizontal vector Y of slope line 42 is altered so that the top of slope line 42 abuts the top of slope line 44 on the adjacent blank. Thus, the slope lines 42 and 44 will touch at the same point on intermediate common cut line 4. As a result, corners 46 do not contain pinch points, i.e. angles of less than 90°, resulting in less wear and tear on the cutting knife during cutting of dove tail lock 2 and intermediate cut line 4, and fewer frayed edges on the blanks after the cutting.

As noted previously, the slightly different lengths of the end flaps 22 and 26 compensate for the thickness of the material of the blank. See FIG. 4 and FIG. 6.

In alternate embodiments, slope lines 42 and 44 may have different geometric arrangements, for example, containing only an angled segment without a first segment that extends perpendicular to the base line. However, in these embodiments, the integrity of the horizontal vector of sides 42 and 44 is maintained. That is to say, side 42 would still have the same horizontal vector Y, whereas slope line 44 would have a horizontal vector X, different from that of Y, resulting in the elimination of corners with angles of less than 90° when adjacent container blanks touch on a larger paperboard substrate.

Although the invention has been described with reference to preferred embodiments, it will be appreciated by one of ordinary skill in the art that numerous modifications are possible in light of the above disclosure. For example, the base line of the dove tail locks may be cut non-parallel to the edge of the blank or intermediate cut line. Further, the slope lines of the dove tail locks may be further segmented. All such variations and modifications are intended to be within the scope and spirit of the invention as defined in the claims appended hereto.

I claim:

1. A container having a base panel, two opposing side walls and two opposing end walls, formed from a unitary blank, comprising:

(a) a first end flap and second end flap foldably attached to a first of said opposing side walls, wherein said first and second end flaps have a top edge, (b) a third end flap and fourth end flap foldably attached to a second of said opposing side walls, wherein said third and fourth end flaps have a top edge, (c) at least one recess cut from the top edge of said first end flap, said recess comprising, a base line having a first end and a second end, a first slope line angled divergently from the first end of said base line to a first point on said top edge, wherein said first point is horizontally displaced from said first end by a first distance, and a second slope line angled divergently from a second end of said baseline to a second point on said top edge, wherein said second point is horizontally displaced from said second end by a second distance, wherein the first distance is different than the second distance, and (d) wherein, said first slope line comprises a first segment and a second segment, wherein said first segment extends perpendicularly from the first end of said base line, and said second segment extends from said first segment to said top edge at an angle divergent from said second slope line, and wherein said second slope line comprises a first segment and a second segment, wherein said first segment extends perpendicularly from the second end of said base line, and said second segment extends from said first segment to said top edge at an angle divergent from said first slope line.

2. The container according to claim 1, wherein said container further comprises a first corner panel foldably attached between said first side wall and said first end flap, a second corner panel foldably attached between said first side wall and said second end flap, a third corner panel foldably attached between said second side wall and said third end flap, and a fourth corner panel foldably attached between said second side wall and said fourth end flap.

3. The container according to claim 2, wherein a first width of said first corner panel and said fourth corner panel are equal, and a second width of said second corner panel and said third corner panel are equal, wherein the first width and the second width are not equal.

4. The container according to claim 1, wherein a first of said opposing end walls comprises said first end flap, said third end flap and an end wall panel configured in a flush, face-to-face arrangement.

5. The container according to claim 4, wherein said third end flap further comprises at least one recess on its top edge, said recess on said third end flap aligning with said recess on said first end flap.

6. The container according to claim 1, wherein a first width of said first end flap and said fourth end flap are equal, and a second width of said second end flap and said third end flap are equal, wherein the first width and the second width are not equal.

7. The container according to claim 1, wherein said base line is parallel to said top edge.

8. A unitary blank comprising a bottom panel, opposite side panels foldably joined to opposite sides of the bottom panel, end flaps foldably joined to opposite ends of the side panels, said end flaps having top edges, opposite end panels foldably joined to opposite ends of the bottom panel, said end panels having top edges, and a locking flap foldably joined to said top edge of said end panels, said side and end panels and said end flaps being foldable into an upright position to form an erected open-top container with said end panels and end flaps disposed in overlying relationship to one another and said locking flap folded over said top edges of the end panels and end flaps to hold the container in its erected condition, wherein at least one recess is cut in the top edge of said end flaps to form a dove tail lock to receive at least a part of said locking flap when in the operative folded condition, said recess comprising, a base line having a first end and a second end, a first slope line extending from the first end of said base line to a first point on the top edge of said end flap, said first point horizontally displaced from said first end by a first distance, a second slope line extending from the second end of said base line to a second point on said top edge of said end flap, said second point horizontally displaced from said second end by a second distance, wherein said first distance is different than said second distance.

9. The unitary blank according to claim 8, wherein said first slope line is a cut line angled divergently from said second base line, said second slope line is a cut line angled divergently from the first slop line, wherein the angle for said first slope line is different than the angle for said second slope line.

10. The unitary blank according to claim 9, wherein said first slope line comprises a first segment and a second segment, wherein said first segment extends perpendicularly from the first end of said base line, and said second segment extends from said first segment to said top edge at an angle divergent from said second slope line, and wherein said second slope line comprises a first segment and a second segment, wherein said first segment extends perpendicularly from the second end of said base line, and said second segment extends from said first segment to said top edge at an angle divergent from said first slope line.

11. The unitary blank according to claim 8, wherein said base line is parallel to said top edge.

12. A container having a base panel, two opposing side walls, two opposing end walls, and an open top, formed from a unitary blank, comprising:

(a) a first end flap and second end flap foldably attached to a first of said opposing side walls, wherein said first and second end flaps have a top edge, (b) a third end flap and fourth end flap foldably attached to a second of said opposing side walls, wherein said third and fourth end flaps have a top edge, (c) said first and third end flaps forming, in part a first of said opposing end walls, and said second and fourth end flaps forming, in part, a second of said opposing end walls said top edges of said first, second third and fourth end flaps defining, in part said open top:

(d) at least one recess cut from the top edge of said first end flap, said recess comprising, a base line having a first end and a second end, a first slope line angled divergently from the first end of said base line to a first point on said top edge, wherein said first point is horizontally displaced from said first end by a first distance, and a second slope line angled divergently from a second end of said base line to a second point on said top edge, wherein said second point is horizontally displaced from said second end by a second distance, wherein the first distance is different than the second distance, and wherein a first width of said first end flap and said fourth end flap are equal, and a second width of said second end flap and said third end flap are equal, wherein the first width and the second width are not equal.

13. A corrugated substrate having multiple blanks for folding into containers, comprising, a first container blank, a second container blank, said first and second blanks bordering along an intermediate cut line, said first container blank having at least one recess in an edge thereof, said recess comprising, a first base line having a first end and a second end, a first slope line angled divergently from the first end of said first base line to a first point on said intermediate cut line, wherein said first point is horizontally displaced from said first end of said first base line by a first distance, a second slope line angled divergently from the second end of said base line to a second point on said intermediate cut line, wherein said second point is horizontally displaced from said second end of said first base line by a second distance, wherein the horizontal displacement of said first distance is different than the horizontal displacement of said second distance; and wherein said second container blank has at least one recess in an edge thereof, said recess comprising, a second base line having a first end and a second end, said second base line offset from said first base line, a third slope line angled divergently from the first end of said second base line to said second point on said intermediate cut line, wherein said first point is horizontally displaced from said first end of said second base line by said first distance, a fourth slope line angled divergently from the second end of said base line to said first point on said intermediate cut line, wherein said second point is horizontally displaced from said second end of said second base line by said second distance wherein the location on the intermediate cut line of the first and second points of the first blank corresponds to the location on the intermediate cut line of the first and second points of the second blank, whereby the formation of pinch points is avoided.

14. The paperboard substrate according to claim 13, wherein said first and third slope lines on said first and second container blanks comprise a first segment and a second segment, wherein said first segment extends perpendicularly from the first end of said base line, and said second segment extends from said second slope line, and wherein said second and fourth slope lines on said first and second container blanks comprise a first segment and a second segment, wherein said first segment extends perpendicularly from the second end of said base line, and said second segment extends from said first slope line.

15. The paperboard substrate according to claim 13, wherein said second base line is parallel to said intermediate cut line.

16. The paperboard substrate according to claim 13, wherein said second base line is parallel to said intermediate cut line.

17. A container having a base panel, two opposing side walls and two opposing end walls, formed from a unitary blank, comprising:

(a) a first end flap and second end flap foldably attached to a first of said opposing side walls, wherein said first and second end flaps have a top edge, (b) a third end flap and fourth end flap foldably attached to a second of said opposing side walls, wherein said third and fourth end flaps have a top edge, (c) at least one recess cut from the top edge of said first end flap, said recess comprising, a base line having a first end and a second end, a first slope line angled divergently from the first end of said base line to a first point on said top edge, wherein said first point is horizontally displaced from said first end by a first distance, and a second slope line angled divergently from a second end of said base line to a second point on said top edge, wherein said second point is horizontally displaced from said second end by a second distance, wherein the first distance is different than the second distance, and said container further comprises a first corner panel foldably attached between said first side wall and said first end flap, a second corner panel foldably attached between said first side wall and said second end flap, a third corner panel foldably attached between said second side wall and said third end flap, and a fourth corner panel foldably attached between said second side wail and said fourth end flap.

18. A container having a base panel, two opposing side walls, two opposing end walls, and an open top, formed from a unitary blank, comprising:

(a) a first end flap and second end flap foldably attached to a first of said opposing side wails, wherein said first and second end flaps have a top edge, (b) a third end flap and fourth end flap foldably attached to a second of said opposing side wails, wherein said third and fourth end flaps have a top edge, (c) at least one recess Cut from the top edge of said first end flap, said recess comprising, a base line having a first end and a second end, a first slope line angled divergently from the first end of said base line to a first point on said top edge, wherein said first point is horizontally displaced from said first end by a first distance, and a second slope line angled divergently from a second end of said base line to a second point on said top edge, wherein said second point is horizontally displaced from said second end by a second distance, wherein the first distance is different than the second distance, and wherein a first of said opposing end wails comprises said first end flap, said third end flap and an end wall panel configured in a flush, face-to-face arrangement, with the top edges of the first and third end flaps being in aligned registry with one another and deflning, in part said open top.

* * * * *